United States Patent [19]

v. Habsburg-Lothringen

[11] 4,054,115

[45] Oct. 18, 1977

[54] MINIATURE INTERNAL COMBUSTION ENGINE

[76] Inventor: Leopold v. Habsburg-Lothringen, Gabelsbergerstr. 15, Munich 2, Germany, 800

[21] Appl. No.: 584,766

[22] Filed: June 9, 1975

[30] Foreign Application Priority Data

Oct. 31, 1974 Germany ..... 2451948

[51] Int. Cl.[2] ..... F02F 1/00; F01C 9/00

[52] U.S. Cl. ..... 123/193 CP; 123/197 R; 123/197 A; 92/177; 277/148; 277/154

[58] Field of Search ..... 123/197 R, 197 A, 197 AB, 123/197 AC, 193 CP, 193 C, 193 P; 92/177; 74/54, 55, 25; 277/148, 154, 160

[56] References Cited

U.S. PATENT DOCUMENTS

| | | | |
|---|---|---|---|
| 750,336 | 1/1904 | Bentz | 123/197 R |
| 1,505,856 | 8/1924 | Briggs | 123/197 AC |
| 1,529,721 | 3/1925 | Ross | 92/177 |
| 1,728,514 | 9/1929 | Snyder | 92/177 |
| 2,180,674 | 11/1939 | Geisse | 123/197 R |
| 2,409,555 | 10/1946 | Gadoux et al. | 277/148 |
| 2,696,414 | 12/1954 | Green | 277/148 |
| 2,884,290 | 4/1959 | Morrow | 92/177 |
| 2,939,439 | 6/1960 | Meurer | 123/32 B |
| 3,734,072 | 5/1973 | Yamda | 123/73 A |

*Primary Examiner*—Carroll B. Dority, Jr.
*Assistant Examiner*—David D. Reynolds
*Attorney, Agent, or Firm*—W. G. Fasse; W. W. Roberts

[57] ABSTRACT

An internal combustion engine has a cylinder and a piston with rectangular cross sections. A guideway slot extends across one face of the piston, and engages an off-center pin affixed to the crankshaft for translating linear movement of the piston to rotational movement of the crankshaft. The cylinder may be formed of four side wall plates mounted to define the side walls of the cylinder, and plate means covering the ends of the side wall plates to define a combustion chamber and a crankcase. The crankshaft may be hollow, to define a fuel inlet passageway.

18 Claims, 7 Drawing Figures

10
11
12
IV
33
41
33
14a
60
35
V
35
42
14a
VI
35
44
40
35
60

11
12
40
10
44
56
31
35
61
50
32
61
34
31

33
41
44
15
50
35
IV 18
53
17
17a
52
24
18
17
51
16
21
54

MINIATURE INTERNAL COMBUSTION ENGINE

BACKGROUND OF THE INVENTION

This invention relates to internal combustion engines, and is particularly directed to a miniature internal combustion engine in which the fuel for the engine is directed to the engine through a hollow crankshaft.

Internal combustion engines having a fuel inlet suction passageway extending through the crankshaft are as such known. German Offenlegungsschrift No. 1,526,345 discloses a single cylinder, two piston Otto or Diesel four cycle motor, in which the connecting rod extends into the crank housing. In this arrangement, the work energy is transferred from the piston to the fly wheel by way of the connecting rod and the crankshaft. This arrangement is not well adapted for use as a miniature motor.

A construction for an internal combustion engine has long been sought, which enables the smallest possible size of the engine, but yet is sufficiently variable that the same principles may be employed as in the construction of larger engines. It is thus desirable to provide an engine which may be employed in toys, such as model airplanes, and model ships, but which may also be constructed in larger size, for example, for use in lawn mowers and even in vehicles.

German Offenlegungsschrift No. 2,117,207 discloses an internal combustion engine having two cylinders arranged in a housing. This arrangement requires, however, the provision of two drive means for the pistons. As a consequence, the engine of this reference cannot be designed to have the least possible overall size.

In further known arrangements, the transmission of force from the piston is accomplished without any crankshaft. For example, German Offenlegungsschrift No. 1,576,043 as well as German Offenlegungsschrift No. 2,015,165 disclose arrangements in which the cylinder pistons are cyclically controlled by a grooved roller and a ball guided therein. In a somewhat similar manner, the force is transferred without any crankshaft by way of a ball guided in a wave shaped groove in the cylinder. This type of construction results in quite compact engines but the number of elements is high, and the size of such engines is still greater than desired.

OBJECTS OF THE INVENTION

In view of the above, it is the aim of the present invention to achieve the following objects, singly or in combination:

to provide an internal combustion engine which overcomes the above disadvantages of known internal combustion engines;

to provide an internal combustion engine which is adaptable to be manufactured by the same techniques in miniature sizes as well as in larger sizes and which may be produced in the smallest possible sizes; and to provide a miniature internal combustion engine in which the cost of construction and the cost of the components thereof are minimized, and which is capable of being produced in the smallest possible size from few parts.

SUMMARY OF THE INVENTION

Briefly stated, in accordance with the invention, the above objects are achieved by providing an internal combustion engine in which the working piston has an essentially rectangular cross section. A guide slot is provided in a side of the piston. The slot extends normal to the axis of the cylinder. The crankshaft has an axis normal to the axis of the cylinder, and a pin, offset from the axis of the crankshaft, is secured to a plate affixed to the end of the crankshaft. The pin extends into the guide slot of the piston, the guide slot extending in a plane normal to the axis of the crankshaft. Consequently, upon up and down movement of the piston, the linear movement of the piston is translated to rotational movement of the crankshaft by way of the pin on the crankshaft.

Such a construction for an internal combustion engine not only enables a truly optimal reduction in the size of the motor, but also the full use of the crankcase compression space. Further it enables a better compression ratio than was obtainable in previous motors.

In a further embodiment of the invention, four side wall plates are arranged in the cylinder housing, these side wall plates serving to guide the piston as well as forming separating walls for the passageways in the engine. The side wall plates are provided with openings for the passageways, i.e. the fuel inlet passageways and the gas exhaust ports. This arrangement considerably minimizes the requirements for close tolerances in the manufacture of the cylinder, and hence reduces the expense of manufacture of the engine. In the production of known cylinders, the rejection rate of the cylinder was relatively high due to the required high cylinder grinding quality and also due to machine failures and personnel errors, and as a consequence, the losses due to such high rejection rate were high. By fabricating the cylinder walls of plates, in accordance with the present invention, it is only necessary to discard those individual plates which cannot be repaired, rather than discarding the entire cylinders, as was previously required. In addition, in the arrangement of the invention, the cost of fabricating the cylinder for the engine is considerably reduced because it is easier to produce the high surface finish on a plane than on an internal cylinder surface.

Further, in accordance with the invention, suitable sealing moldings are arranged on the piston and urged by means of a spring force against the wall plates to enable movement of the piston along the wall plates while sealing the spaces therebetween. These sealing moldings need not be rigidly connected to each other at the corners but they meet at the corners and these moldings may be curved, for example, at two opposite surfaces and straight at the two other opposite surfaces. This arrangement is very easy to assemble, and enables replacement of the sealing means in the shortest possible time. The sealing arrangement is trouble free, as compared with known cylinder sealing arrangements.

BRIEF FIGURE DESCRIPTION

In order that the invention may be clearly understood, it will now be described, by way of example, with reference to the accompanying drawings, wherein.

DETAILED DESCRIPTION OF EXAMPLE EMBODIMENTS

Figures 1, 2, 3, 7:
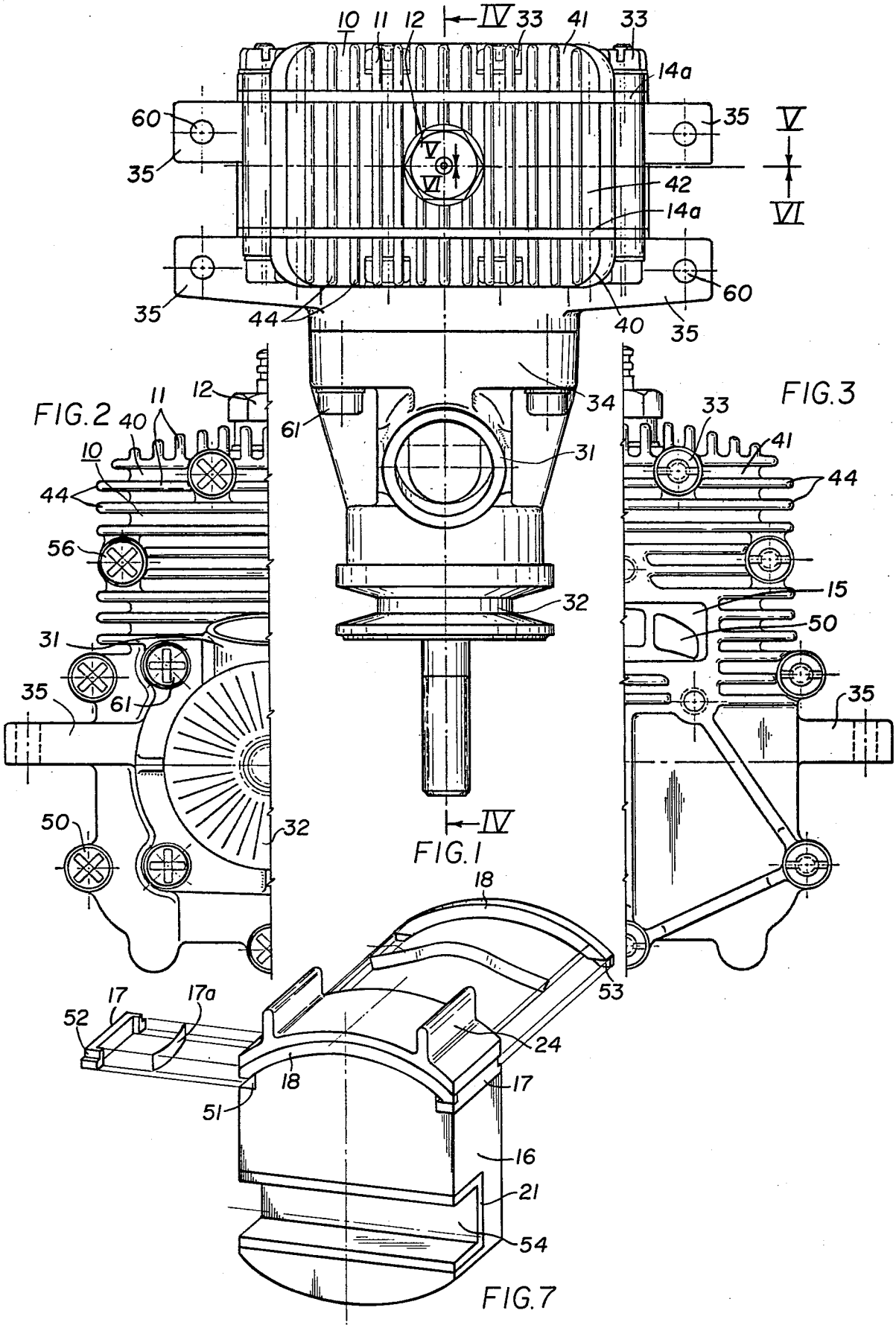
FIG. 1 is a top view of an internal combustion engine in accordance with the invention.
FIG. 2 is a front view of one half of the internal combustion engine of FIG. 1 to one side of a vertical plane extending through the center of the engine, the other half of the front of the engine having a similar configuration.
FIG. 3 is a rear view of one half of the engine of FIG. 1 to one side of a vertical plane extending through the center of the engine, the other side of the engine having a similar appearance.
FIG. 7 is an exploded perspective view of the piston and sealing arrangement, which may be employed in the internal combustion engine of FIG. 1.
Figure 4:
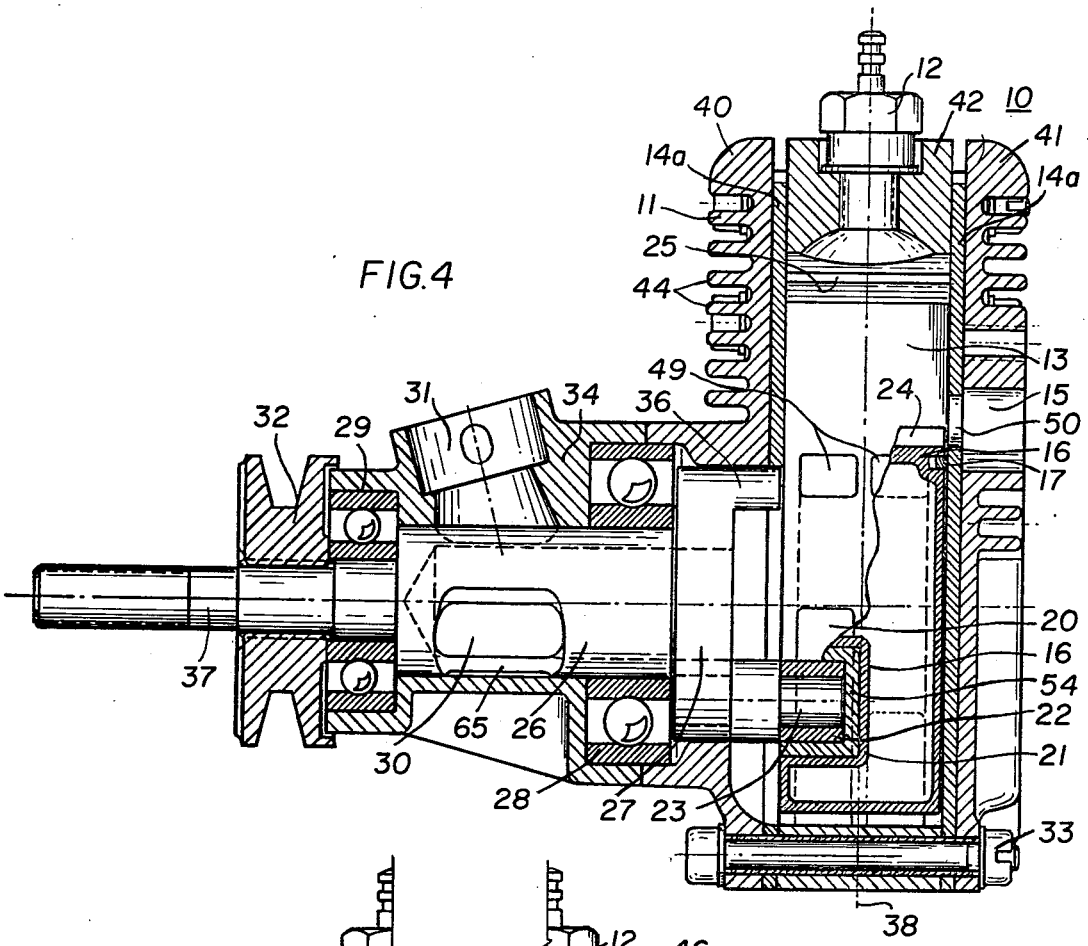
FIG. 4 is a cross sectional view of the engine of FIG. 1, taken along the lines IV—IV.
Figure 5:
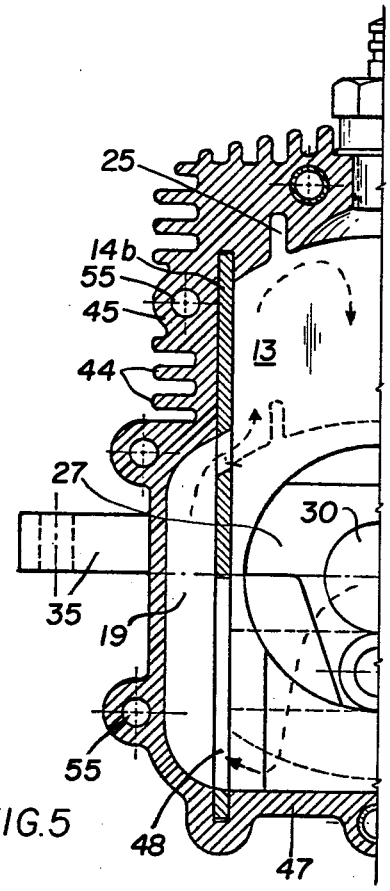
FIG. 5 is a partial cross sectional view of the engine of FIG. 1, looking toward the front of the engine and taken along the lines V—V in FIG. 1.
Figure 6:
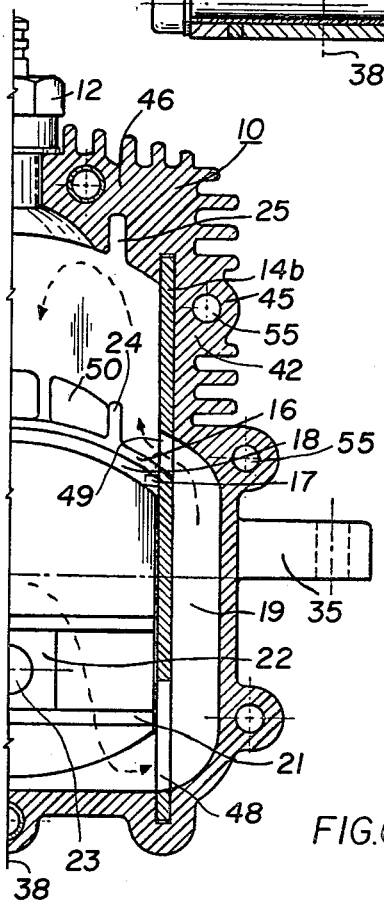
FIG. 6 is a partial cross sectional view of the engine of FIG. 1, looking toward the rear of the engine and taken along the lines VI—VI in FIG. 1.

The drawings illustrate one embodiment of an internal combustion engine in accordance with the invention, which may be designed as either a two cycle engine or a four cycle engine. The engine is provided with a cylinder housing 10, which as opposed to the conventional cylinders having circular cross sections, has a rectangular cross section. Thus, as illustrated most clearly in FIG. 4, the cylinder is formed of a pair of parallel internal wall plates 14*a* extending in planes normal to the crankshaft axis 37. Wall plates 14*b*, as illustrated in FIG. 5 abut the wall plates 14*a*, to form a rectangular or square chamber. As illustrated in FIG. 1, the wall plates 14*a* may extend to the exterior of the cylinder housing. The cylinder housing further comprises a front plate 40, a rear plate 41, as illustrated in FIGS. 1 to 4 and a center plate 42 between the wall plates 14*a*, as illustrated in FIGS. 1 and 5. The plates 40, 41 and 42 are provided with conventional cooling ribs 44. As illustrated in FIGS. 1, 5 and 6, the center member 42 has lateral portions 45 outside of the wall plates 14*b*, a top portion 46 extending over the top of the combustion chamber and a lower portion 47 between the side portions 45 and defining the lower portion of the cylinder and the chamber beneath the piston. The wall plates 14*a*, 14*b* and the top portion 46 of member 45 thus define the combustion chamber 13. A piston 16, which will be described in greater detail in the following paragraphs, is provided in the chamber 13 defined by the wall plates 14*a*, 14*b*.

Referring to FIGS. 5 and 6, passageways 19 are formed in the lower portion of the member 45, outside of the wall plate 14*b*, and the wall plates 14*b* are provided with lower openings 48 and upper openings 49, above the lowermost position of the top of the piston 16, and communicating with the passageway 19. In addition, as illustrated in FIG. 4, a gas exhaust 15 is provided extending through the outer plate 41, and an opening 50 in the adjacent wall plate 14*a* communicates with the opening 15.

The piston 16, which is more clearly illustrated in FIG. 7, has a rectangular or square cross section. Grooves 51 are provided extending around the periphery of the piston adjacent its upper edge and elongated sealing bars 17, 18 are fitted in the grooves 51 and urged outwardly therefrom, by springs 17*a* and 18*a* respectively. For example, as illustrated in FIG. 7, the sealing bars 17 may be provided in the grooves 51 facing the wall plates 14*b*, these bars having end notches 52 so that they may overlap the bars 18. The bars 18 may be curved, to conform to the curved upper surface of the piston, and the bars 18, which are positioned to slidably engage the wall plates 14*a*, may have end grooves 53 to overlap the ends of the bars 17, thereby providing a complete slidable seal in the cylinder. Ribs 24 are provided extending upwardly from the top of the piston, and adapted to extend into similarly shaped recesses 25 in the section 46 of the member 45 in the upper position of the piston, as illustrated in FIGS. 5 and 6. The ribs 24 serve to prevent oppositely directed eddy currents, and also to inhibit direct discharge of the fuel entering the combustion chamber with the exhaust gases.

The piston 16 is further provided with a transversely extending guideway 21, in the surface thereof toward the front of the engine. The guideway 21, which extends transversely of the axis of the cylinder is preferably lined with a suitable bearing surface 54, such as steel plates molded in place by casting or held by screws.

Referring again to FIGS. 5 and 6, the ends of the wall plates 14*b* may extend into slots in the outer member 45 in order to retain these wall plates in position. The members 40, 41 and 42 are provided with aligned holes 55 extending therethrough, through which suitable screws or bolts 56 extend, with nuts 33 being provided on the bolts 56 for clamping the cylinder assembly together. Flanges 35 may be provided, for example, on the members 40 and 42, to enable the mounting of the motor, these flanges being suitably provided with mounting holes 60. A crank opening is provided in the lower portion of the plate 40, as illustrated in FIG. 4, with the periphery of this opening extending forwardly for attachment thereto of a crank housing 34, for example, by means of bolts 61. A similar shaped opening is provided in the side wall 14*a* adjacent the wall plate 40. A crankshaft 26 is rotatably mounted in the crank housing 34, for example, by means of roller bearings 28, 29, for rotation about an axis extending transversely of the longitudinal axis of the cylinder. A plate 27 is affixed to the internal end of the crankshaft 26, and a pin 23 is affixed to the plate 27 in a position offset from the axis 37 of the crankshaft, the pin 23 extending into the guideway 21. A glide sleeve 22 on the pin 23 slidably engages the guideway 21. A balancing weight 36, which may form a part of the plate 27, is provided to balance the crankshaft. A pulley, for example, a V-belt pulley 32 may be provided on the outer end of the crankshaft 26. The bearing surface 54 of the piston, which engages the sleeve 22, may be formed of a cast-in or screwed-in steel layer in the piston.

In the above described arrangement, it is apparent that, as the piston 16 moves linearly up and down along the axis 38 of the cylinder, the linear motion is translated to rotational movement of the crankshaft 26, due to the sliding engagement of the pin 23 and its sleeve 22 in the guideway 21.

A magneto or spark plug 12, or alternatively, a glow plug for a diesel motor may be provided in the member 42 extending into the combustion chamber 13.

The crankshaft 26 is provided with an internal suction bore 30 extending through the end thereof toward the cylinder, but closed in the opposite direction, as illustrated in FIG. 4. The crank housing 34 is provided with a suitable mounting shoulder 31, for mounting a carburetor (not shown) and a port extends from the mounting 31 radially inwardly through the wall of the housing 34. The hole 30 in the crankshaft extends to the region of the mounting 31 and is provided with an outwardly extending port which selectively communicates with the port from the carburetor through the housing 34 upon rotation of the crankshaft 26, whereby the port 65 serves as a valve for the introduction of fuel into the engine.

The course of fuel through the engine is illustrated in FIGS. 5 and 6, wherein the arrows show the course of the fuel from the suction hole 30 of the crankshaft into the passageways 19, through the upper openings 49 in the side walls **14*b*, thence into the combustion chamber 13 between the ribs 24 and side wall plates 14*a*, 14*b* whereby the sidewall plates of the engine are automatically cooled. The gas outlet hole 15 is so positioned that, when the last remaining consumed gas mixture has been expelled from the combustion chamber, the piston 16 closes the opening 15**, so that discharge of the new inflowing or injected fuel is prevented.

The invention, as above described, thus provides a miniature internal combustion engine whose effective size may be much smaller than shown in the FIGURES. As a result of the simplification of manufacture of the engine, the relative low tolerances provided in the cylinder and the substantially complete use of the crankcase space, it is apparent that the present invention provides an engine that has the least possible size and is yet adaptable to manufacture in larger sizes, and that is efficient in its operation.

Although the invention has been described with reference to specific example embodiments, it is to be understood, that it is intended to cover all modifications and equivalents within the scope of the appended claims.

What is claimed is:

1. An internal combustion engine comprising a cylinder having a rectangular cross section, a piston having a rectangular cross section defined by a pair of short opposite sides and a pair of long opposite sides, said sides defining four corners, said piston being mounted in said cylinder for movement along the longitudinal axis of said cylinder, a crankshaft having an axis perpendicular to the longitudinal axis of said cylinder, said piston having a guideway in the surface thereof toward said crankshaft, said guideway extending transversely of the axis of said cylinder completely across said surface and only partially through said piston axially of said crankshaft, pin means, means mounting said pin means on said crankshaft in a position offset with respect to the axis of said crankshaft, said pin means extending into said guideway, whereby said pin means couples the crankshaft directly to the piston so that linear movement of said piston in said cylinder is directly translated to rotational movement of said crankshaft by way of said pin means, said piston further comprising a substantially straight groove in each of said short sides and a curved groove in each of said long sides, said grooves merging in said corners, a pair of straight sealing strips inserted in the respective groove of said short piston sides, a pair of curved sealing strips inserted in the respective groove of said long piston sides, separate spring means inserted in each of said grooves for uniformly urging the corresponding sealing strip outwardly, said straight sealing strips having a shoulder at each end with a surface extending perpendicularly to said longitudinal axis, said curved sealing strips having end legs resting on the corresponding shoulder surface of the straight sealing strips at said corners whereby the sealing strips reinforce each other at the corners.

2. The internal combustion engine of claim 1, wherein said means mounting said pin means comprises plate means affixed to the end of said crankshaft toward said cylinder, said pin means being mounted on said plate means, and wherein said pin means comprises a pin affixed to said plate means, and a sleeve surrounding said pin and sliding said guideway.

3. The internal combustion engine of claim 1, wherein said crankshaft has a fuel suction inlet extending at least partially therethrough from the end of said crankshaft adjacent to said cylinder.

4. The internal combustion engine of claim 1, wherein said cylinder comprises four side wall plates, and means including housing means for mounting said plates to define a combustion chamber having a rectangular cross section for guiding said piston for movement along the longitudinal axis of said cylinder.

5. The internal combustion engine of claim 4, wherein said side wall plates have openings defining fuel inlet ports, gas exhaust ports and overflow ports.

6. The internal combustion engine of claim 4, wherein said cylinder further comprises outer plate means secured to the outsides of said wall plates, said outer plate means confining one end of the combustion chamber at one end of said wall plates, said outer plate means further confining a crankcase space at the other end of said wall plates of the combustion chamber.

7. The internal combustion engine of claim 1, further comprising ribs extending upwardly from the top of said piston, said cylinder having recesses into which said ribs extend in the upper position of said piston at which gases in said cylinder are compressed.

8. The internal combustion engine of claim 1, wherein said guideway comprises a slot in said piston, and a steel lining in said slot for slidably engaging said pin means.

9. An internal combustion engine comprising four plates mounted to define a cylinder having a rectangular cross section, a piston having a rectangular cross section defined by a pair of short opposite sides and a pair of long opposite sides, said sides defining four corners, said piston being positioned in said cylinder for slidable movement along the longitudinal axis thereof, means covering said plates at one end to define, in combination with said four plates a combustion chamber at one end of said piston, means covering said four plates at the other ends thereof to define, in combination with said four plates a crankcase at the other end of said piston, a crankshaft rotatably mounted about an axis normal to the axis of said cylinder, a guideway slot extending completely across the surface of said piston facing toward said crankshaft in a direction normal to the longitudinal axis of said cylinder, said slot extending only partway through said piston in the axial direction of said crankshaft, pin means slidably engaging said guideway and mounted on said crankshaft at a position offset from the axis thereof, whereby linear movement of said piston in said cylinder is translated to rotational movement of said crankshaft by way of said pin means, said piston further comprising a substantially straight groove in each of said short sides and a curved groove in each of said long sides, said grooves merging in said corners, a pair of straight sealing strips inserted in the respective groove of said short piston sides, a pair of curved sealing strips inserted in the respective groove of said long piston sides, separate spring means inserted in each of said grooves for uniformly urging the corresponding sealing strip outwardly, said straight sealing strips having a shoulder at each end with a surface extending perpendicularly to said longitudinal axis, said curved sealing strips having end legs resting on the corresponding shoulder surface of the straight sealing strips at said corners whereby the sealing strips reinforce each other at the corners.

10. The internal combustion engine of claim 9, further comprising a crank housing secured to said cylinder, said crankshaft being rotatably mounted in said crank housing, an inlet port extending through said crank housing, said crankshaft having a hole extending longitudinally from the end thereof adjacent to said cylinder and having a port communicating with said inlet port, said wall plate means having openings defining passageways for fuel between said combustion chamber and said end of said crankshaft and further openings in said wall plate means to provide gas exhaust port means as well as overflow port means.

11. The internal combustion engine of claim 1, wherein said cylinder comprises first, second, third, and fourth flat plates, and housing means for mounting said flat plates to define separate side walls of said cylinder.

12. The internal combustion engine of claim 13, wherein said housing means comprises a central housing member having two pairs of flat opposite sides and a central aperture, means mounting said first and second plates in spaced apart parallel relationship in said aperture to extend normal to one pair of said opposite sides, and means mounting said third and fourth plates on the other pair of said sides, whereby said plates and central housing member define a combustion chamber at one end of said cylinder and a crankcase at the other end of the cylinder.

13. The internal combustion engine of claim 14, wherein said housing means further comprises first and second outer housing members mounted externally on said third and fourth plates respectively, whereby said third and fourth plates are sandwiched between said central housing member and said first and second outer housing members, respectively.

14. The internal combustion engine of claim 13, wherein said third plate has an aperture extending therethrough, said pin extending through said aperture in said third plate for engagement with said guideway, said aperture in said third plate being spaced from said combustion chamber.

15. The internal combustion engine of claim 14, comprising inlet port means in at least one of said first and second plates, and inlet duct means in said central housing member aligned with said inlet port means and leading to said crankcase in said cylinder.

16. The internal combustion engine of claim 15, further comprising exhaust port means in said fourth plate.

17. The internal combustion engine of claim 14, wherein said central housing member comprises a single plate having grooves extending between said opposite sides, said first and second plates mounted in said aperture being inserted in said grooves.

18. The internal combustion engine of claim 13, further comprising a groove extending around said piston, and sealing means in said groove for sealingly engaging the inside surfaces of said cylinder, said sealing means comprising a separate bar in said groove on each side of said piston, said bars extending to the respective corners of said piston and overlapping the bars on adjacent sides of said piston at said corners, and spring means in said grooves for urging said bars outwardly against the inner side walls of said cylinder.

* * * * *

UNITED STATES PATENT OFFICE

CERTIFICATE OF CORRECTION

Patent No. 4,054,115 Dated October 18, 1977

Inventor(s) Leopold v. Habsburg-Lothringen

It is certified that error appears in the above-identified patent and that said Letters Patent are hereby corrected as shown below:

Column 7, line 17, "13" should read -- 11 --;
line 28, "14" should read -- 12 --.
Column 8, line 16, "14" should read -- 12 --;
line 21, "13" should read -- 11 --.

Signed and Sealed this
Seventh Day of March 1978

[SEAL]

*Attest:*

RUTH C. MASON
*Attesting Officer*

LUTRELLE F. PARKER
*Acting Commissioner of Patents and Trademarks*